US008791364B2

(12) United States Patent
Paoletti

(10) Patent No.: US 8,791,364 B2
(45) Date of Patent: Jul. 29, 2014

(54) LOW-NOISE CABLE

(75) Inventor: Umberto Paoletti, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 600 days.

(21) Appl. No.: 13/021,036

(22) Filed: Feb. 4, 2011

(65) Prior Publication Data

US 2011/0243255 A1 Oct. 6, 2011

(30) Foreign Application Priority Data

Apr. 5, 2010 (JP) ..... 2010-087006

(51) Int. Cl.
*H01R 4/00* (2006.01)

(52) U.S. Cl.
USPC ..... 174/74 R; 174/75 C; 174/78; 174/79

(58) Field of Classification Search
USPC ..... 174/36, 74 R, 77 R, 78, 84 R, 88 R, 88, 174/110 R, 102 R; 333/243
See application file for complete search history.

(56) References Cited

U.S. PATENT DOCUMENTS

| | | | | |
|---|---|---|---|---|
| 3,469,016 | A | 9/1969 | Shelton | |
| 4,257,658 | A | 3/1981 | Hammond et al. | |
| 4,506,235 | A | 3/1985 | Mayer | |
| 5,287,074 | A | 2/1994 | Meguro et al. | |
| 5,597,314 | A | 1/1997 | Auclair et al. | |
| 5,763,825 | A * | 6/1998 | Gilliland | 174/36 |
| 5,831,210 | A * | 11/1998 | Nugent | 174/27 |
| 5,990,417 | A | 11/1999 | Senda et al. | |
| 6,054,649 | A * | 4/2000 | Uchida et al. | 174/36 |
| 6,225,565 | B1 * | 5/2001 | Prysner | 174/120 SC |
| 6,284,971 | B1 | 9/2001 | Atalar et al. | |
| 6,335,483 | B1 | 1/2002 | Uchida et al. | |
| 6,413,103 | B1 | 7/2002 | Merz et al. | |
| 6,485,335 | B1 | 11/2002 | Dewdney | |
| 6,791,026 | B2 | 9/2004 | Muraki | |
| 6,867,362 | B2 * | 3/2005 | Cherniski et al. | 174/36 |
| 7,173,182 | B2 * | 2/2007 | Katsuyama et al. | 174/36 |

OTHER PUBLICATIONS

C. R. Paul, "Analysis of Multiconductor Transmission Lines," 2nd edition, Wiley-IEEE Press, 2007, p. 160-167.

S. A. Saario, et al., "Full-Wave Analysis of the Choking Characteristics of a Sleeve Balun on Coaxial Cables," Electronics Letters, vol. 38, No. 7, pp. 304-305, Mar. 2002.

J. D. Kraus, "Antennas" , 2nd edition, McGraw-Hill, 1988, p. 734-745.

C. Icheln, et al., "Dual-Frequency Balun to Decrease Influence of RF Feed Cables in Small-Antenna Measurements, " Electronic Letters, vol. 36, No. 21, pp. 1760-1761, Oct. 2000.

* cited by examiner

*Primary Examiner* — William H Mayo, III
(74) *Attorney, Agent, or Firm* — Crowell & Moring LLP

(57) ABSTRACT

A low noise communication cable is provided having a plurality of internal conductors covered by one or a plurality of cable shields, which are covered by a cable insulator. The cable includes a quarter wavelength sleeve choke outside the cable insulator connected to the cable shield by means of a conducting support. The sleeve choke reduces the noise current flowing on the external surface of the cable shield.

21 Claims, 7 Drawing Sheets

LOW-NOISE CABLE

BACKGROUND

The present invention relates to the reduction of electromagnetic interference (EMI) in a broad sense, including emissions, susceptibility and information leakage, and in particular to the reduction of unintentional electric current on shields of one-shielded and multi-shielded cables.

Electromagnetic interference in electronic equipment is generated by the presence of disturbing intentional or unintentional electromagnetic fields. Intentional electromagnetic fields are deliberately generated for some special purpose, for example fields generated by wireless communication antennas or by broadcast antennas. Since time varying currents generate electromagnetic fields, unintentional electromagnetic fields can be generated by any electronic equipment. Digital circuits are broadband sources of unintentional electromagnetic radiation, and they are often in contact with or in proximity of conductors of dimensions comparable with the wavelength at some particular frequency. Such conductors can act as effective source or receiving antennas.

Conducting cables are an example of effective radiating antennas, particularly due to discontinuities of the cross section along the cable length, such as bends or terminations. Cables can act also as unintentional electromagnetic waveguide and contribute to increase the conducted EMI, or provide the path between the source and the antenna. High frequency electromagnetic waves can be guided by single or multi-conductor cables. In the case of two conductors, two fundamental propagation modes are possible at any non-zero frequency, which are sometimes called differential mode (DM) and common mode (CM) depending on the current polarity 18, as shown in FIGS. 8 and 9.

In the case of more than two conductors the number of fundamental modes increases, as shown for example in the non patent document 1, where however the CM is not considered. For any number of conductors it is possible to define a propagation mode with the same polarity for the current in all the conductors, and this will be called CM or universal common mode (UCM) in the following. The total current carried by the UCM is the algebraic sum of all the currents flowing on all the conductors. The remaining fundamental modes will be called differential modes (DMs) in this patent.

In a similar way, electromagnetic waves can be guided on the external surface of the shield or shields of multi-shielded cables. If the shielding effectiveness is large enough (well shielded cables), the field inside and outside the cables can be considered uncoupled and in the UCM definition the internal conductors, including the internal part of the shields, should not be considered. For example, in the case of a single well shielded cable, like a coaxial cable, the current flowing outside the cable will be called CM or UCM current. The value of shielding effectiveness necessary for considering the field as uncoupled depends on the application of interest, and on the relative intensities of the field inside and outside the cable, for example a 1% reduction of the field would require approximately 40 dB of shielding effectiveness. Internally to the shield, the shield can be taken as reference conductor and a local definition of common mode (LCM) with return current on the internal part of the shield can be used for multi-conductor cables such as the twin axial (twinax) cable.

On the external part of the shields the DM currents are a sort of noise, and the term shield differential modes (SDMs) will be used, in order to distinguish them from the DMs selected for the intentional signal currents on other eventually present unshielded cables. The SDMs include modes made by a combination of currents on shields of shielded cables and on unshielded cables. For convenience the term shield common mode (SCMs) will be used for the UCM when only shielded cables are present, and for those SDMs having the same current polarity on all the shielded cables, but a different polarity in at least one unshielded cable.

In the case of cables with two or more shielding levels, such as the HDMI cable, or a combination of these cables eventually also in configurations with higher shielding levels, local definitions of the previously defined modes are possible for well shielded cables. This means that the previous definitions can be applied to the highest shielding level outside all the shields, as well as inside intermediate shielding levels, with local SDMs and SCMs.

The present invention relates with the reduction of the unintentional currents flowing on cable shields, that is the SCM current and the SDM currents. In the embodiments of FIGS. 3 and 6 only the most external shields are considered. In the embodiment of FIG. 7 the shields of any shielding level are considered.

The mentioned problems related to EMI are usually indicated as conducted and radiated emission problems. Obviously for the same reasons, current on cable shields plays a role also in the reciprocal problem of the susceptibility of electronic equipment to EMI, to the related problems of immunity by electrostatic discharge, EMP (electromagnetic pulse) and lightning. Another important issue is that of prevention of information leakage through direct or indirect coupling with shielded cables present in the environment, not necessarily attached to the emitting electronic equipment. By aiming at reducing the current flowing on the cable shields, the present invention relates at least with all these fields.

In order to reduce the shield current EMI filters are often used, in many cases based on a similar principle to those used for CM current for example in the foreign patent document 1: U.S. Pat. No. 4,506,235. Ferrite chokes have been proposed in many patents, such as the foreign patent document 2: U.S. Pat. No. 6,867,362 and the foreign patent document 3: U.S. Pat. No. 6,335,483. A combination of ferrite chokes at different frequencies has been proposed for example in the foreign patent document 4: U.S. Pat. No. 5,287,074. Sheets of absorbing materials have been proposed for example in the foreign patent document 5: U.S. Pat. No. 5,990,417.

One advantage of this type of filters is that they can be applied to both shielded and unshielded cables. Usually they do not require an electrical connection to the cable and can be applied without any particular effort to a manufactured cable. They are also wide-band filters. On the other hand, the maximum frequency is limited by the magnetic properties of the used materials, typically below 1 GHz. The reduction of CM current is not always sufficient, typically below 10 dB. Even though no experimental evidence is available, the reduction of SDM current in multi-shielded cables is likely to be even smaller than the reduction of the SCM current, due to the different spatial distribution of the electromagnetic field on the cross section of the cable, because for the SDM currents the energy is mainly concentrated in the space between the shields.

If a filter requires an external connection to the cable shield, such as a grounding connection, the external insulator must be removed. Internal connections between shield and an internal conductor by means of openings through the insulator have been considered for example in the foreign patent document 6: U.S. Pat. No. 3,469,016. External connections to a cable shield are shown for example in the foreign patent document 7: U.S. Pat. No. 4,257,658. This type of connections are typically used for grounding the cable, as explicitly mentioned for example in the foreign patent document 8: U.S. Pat. No. 5,597,314. Connections of a bundle of shielded cables for grounding have been considered for example in the foreign patent document 9: U.S. Pat. No. 6,485,335.

This type of connection is aimed to relatively large and resistant coaxial cables. Grounding of a bundle of micro-coaxial cables has been proposed in the foreign patent document 10: U.S. Pat. No. 6,413,103 B1. In the latter patent, originally separated coaxial cables are electrically contacted together in the transversal direction in one or more position along the cable length by means of two conducting plates a the top and at the bottom, after the removal of the external insulator (jacket) of the coaxial cables. The purpose of the foreign patent document 10 is to reduce EMI by means of one or a plurality of connections to ground, represented by a larger conductor such as the chassis of a portable computer. In general grounding is effective when the distance between the cable and the grounding surface is much smaller than the wavelength.

High frequency serial interface cables have nowadays a clock frequency above 1 GHz. This results in strong EMI emission peaks at few frequencies in the GHz region, related to the interface clock frequency. These large and relatively isolated noise frequencies can be more effectively reduced with narrow-band filters, or with a combination of narrow- and wide-band filters. One disadvantage of narrow-band filters is that they require a more accurate design in order to tune them to the correct frequency. A second disadvantage is that in order to optimize the filter, information on the noise spectrum is necessary. Therefore, depending on the circumstances, the filter cannot usually be designed together with the cable, except for example for cables manufactured for a known specific interface clock frequency.

One of these filters is a quarter-wavelength CM suppressor sleeve, discussed for example in the non patent document 2. This type of filters is an extension of the well known sleeve or bazooka balun, discussed for example in the non patent document 3. The fundamental idea is that a quarter-wavelength long waveguide that is shorted at one termination appears ideally as an open circuit at the opposite terminals. One difficulty in designing these sleeve CM chokes is that in practice the frequency at which the resonance minimizing the CM current transmission occurs, does not correspond exactly to the frequency at which the sleeve is one quarter-wavelength long. The optimal sleeve length depends in practice also on the diameter of the sleeve.

Baluns are used at the transition between balanced and unbalanced cables with the purpose of improving the transmission between the respective propagation modes. The reduction of the CM current is a useful and necessary effect, even though it is not the main purpose. On the other hand the purpose of the quarter-wavelength sleeve choke is to reduce the CM current on a single cable, and therefore some differences in the implementation may exist. For example, the source of CM current does not need to be the transition between a balanced and an unbalanced line. Furthermore, the position of the sleeve does not need to be exactly at the terminals, even though a proximity to the CM source is preferred. For this reason it is also possible to cascade sleeve chokes at difference frequencies, as an alternative to using more complex extensions such as dual frequency sleeve baluns, which are discussed for example in the non patent document 4 and can be applied also to sleeve chokes.

One patent related to the quarter-wavelength sleeve CM suppressors is the foreign patent document 11: U.S. Pat. No. 6,284,971. The field of the invention is slightly different, since the invention is a cable for magnetic resonant imaging. In that case the cable is carrying a single frequency and large power signal, and the CM current can increase the temperature of the cable creating safety risk for the patient. Applications to other fields such as EMI with antennas are considered in the patents. The patent includes a cable having a plurality of sleeve chokes of length corresponding to around one quarter of the wavelength at the operating frequency.

SUMMARY

The main subject of the present invention is a low-noise cable made by a combination of one or more shielded cables, for example coaxial cables, twinax cables, serial interface cables, and other shielded cables. Cables can include connectors at the cable ends, but they do not necessarily need to include them. The different embodiments of the invention provide solutions for reducing the SCM and SDM current, by means of filters or by means of features which simplify the connection of filters to the cable shields.

The cable includes some supports that provide a reflecting termination for SDM currents and simplify the connection between cable shields and EMI filters aimed at reducing the SCM current. In one embodiment the cable presents conducting parts connected to the cable shields and protruding outside the external dielectric insulator, in order to provide a connection to an EMI filter. In a different embodiment the cable jacket presents some openings allowing for a successive connection of the filters. In other embodiments the conducting supports and the openings are covered by a removable insulator.

Its main application is serial interface cables with quarter-wavelength sleeve chokes, but the invention can be used with any shielded cable, such as coaxial or multi conductor shielded cables, and other types or combinations of EMI filters. The present invention allows the user to connect the EMI filter to the cable shields, and thus to optimize the filter according to his needs. When the application is known in advance by the cable maker, it is possible to design the filter together with the cable. Therefore one embodiment covers also the combination of cable and EMI filters, including also combinations of quarter-wavelength sleeve chokes tuned at different frequencies.

This invention solves the problem of the prior arts as mentioned above and provides a cable comprising a shielded cable (100, 110) having an internal conductor (19, 20) covered by an insulator (21, 22) which is wrapped by a conductive cable shield (6) and outside the cable shield (6) is covered by a cable insulator (7), a conducting filter support (5), and a filter (4, 11) which reduces electromagnetic interference, wherein the conducting filter support (5) is connected to the cable shield (6) and extends outside the cable insulator (7).

This invention also provides a cable comprising a shielded cable (120) having plural internal conductors (19, 20) which are covered by insulators (21, 22) and said insulators are wrapped with conductive cable shields (6) and outside the conductive cable shields (6) are covered by a cable insulator (7), a conducting filter support (5), and a filter (4, 11) which reduces electromagnetic interference, wherein the conducting filter support (5) is connected to at least one of the cable shields (6) and extends outside the cable insulator (7).

Further this invention provides a cable comprising a shielded cable (130, 140) having plural internal conductors (19, 20) each covered by a insulator (21, 22), a conducting filter support (5), and a filter (4, 11) which reduces electromagnetic interference, wherein said insulators (21, 22) covering said plural internal conductors (19, 20) are wrapped with conductive cable shield (6, 60) and said conductive cable shield is covered by a cable insulator (7, 70); and wherein the conducting filter support (5) is connected to said conductive cable shield (6, 60) and extends outside the cable insulator (7, 70).

This invention still further provides an electrical equipment comprising a first electric equipment and a second electrical equipment, wherein said first electrical equipment and said second electrical equipment are connected by the cable as defined above.

The main purpose and effect of the invention is the reduction of SCM and SDM current and their electromagnetic radiation. A second effect of some of the embodiments is the simplification of the preparation of SCM filters. A third effect of some of the embodiments is to provide a way to connect the cable shields to grounding conductors or to other conductors, such as another shielded cable.

DESCRIPTION OF THE PREFERRED EMBODIMENTS

In all the following figures the relative dimensions and the shapes do not represent the real proportions and shapes. The figures are only diagrammatic representations for the purpose of clarification. For example, a conductor with a circular cross-section in one drawing does not need to be understood as really circular, unless explicitly said, and it can be of any shape.

Figure 1:
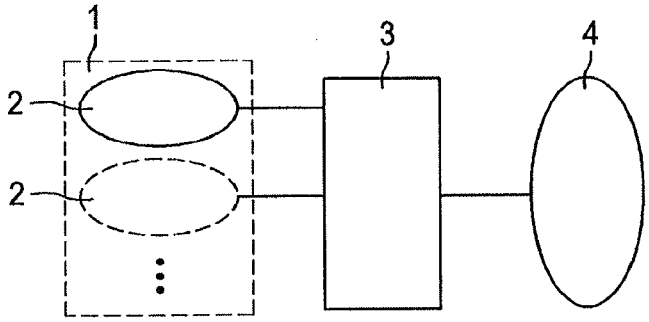
FIG. 1 is a simplified diagram of the invention.

A schematic representation of the invention is shown in FIG. 1. The number 1 indicates a cable which is formed by plural shielded cables 2. Each of the shielded cables 2 is connected to a filter support portion 3. The conducting support is connected to an EMI filter 4.

The cable 1 in FIG. 1 indicates a group of mutually insulated conductors with at least one conductor acting as electromagnetic shield of all, or some, or one of the remaining ones, or of the remaining one. The shields are usually covered by a cable insulator (jacket), either separately or sharing the same one, such as the cable insulator 7 shown in FIG. 2.

Figure 2:
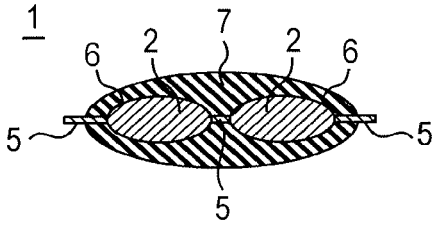
FIG. 2 is a diagrammatic representation of shield connecting elements.

FIG. 2 shows a cross-sectional shape of the cable 1 which contains two shielded cables 2. Each of the shielded cables 2 is shielded by cable shield 6 which is covered by the cable insulator 7. And the cable shields 6 are connected with each other by conducting parts 5.

This definition comprises a cable 1 that is a combination of shielded cables 2, but also a cable 1 that is a combination of one or more shielded cables and one or more unshielded conductors which are not shown in the figure. Since the present invention applies to the shields of the shielded cables 2, in the following only shielded cables will be considered. However, it must be implicitly understood that other unshielded conductors can be present and bound together to form the cable 1.

The shielded cables 2 can be mechanically joint together to form the cable 1, for example with a cable jacket 7 encompassing the shielded cables as in the case of FIG. 2, or they can be less tightly bundled with each other only at the connectors, for example like the lanes of a multi-lane SATA or SAS cable, and possibly but not necessarily at some other positions, like the coaxial cables disclosed by the foreign patent document 10: U.S. Pat. No. 6,413,103.

In the present invention, the cable shields 6 of the shielded cables 2 are connected with each other in one or in a plurality of positions along the cable 1 by means of some conducting filter support portions 3, in order to connect one or a plurality of EMI filters 4. These filter connections are diagrammatically shown with the conducting parts 5 in FIG. 2 for the case that the cable 1 is made of two shielded cables 2. The interior of the shielded cables 2 in this figure is not shown, because it is not relevant to the present invention. The conducting parts 5 provide a direct or indirect connection between all the external shields. The realization of these connections will be explained later. These filter supports represented by the conducting parts 5 can be connected to an EMI filter 4 in FIG. 1 in order to reduce the SCM or to further reduce the SDM. Another usage of the conducting filter support portions 3 can be grounding.

Figure 3:
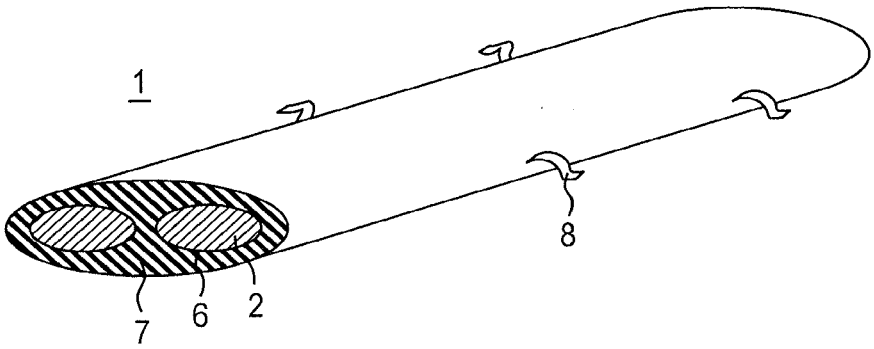
FIG. 3 is a multi-shielded cable with straps or wires.

One embodiment of the invention is shown in FIG. 3. In this embodiment the filter support portions 3 in FIG. 1 are realized by the conducting straps 8. Alternative realizations are by means of conducting wires, or braids or other flexible conductors. The flexibility allows for more simple connections to different types of filters. In the present embodiment the EMI filters 4 are not present, and only the filter support portions 3 (conducting straps 8) for their eventual connection are provided. The conducting straps 8 are equivalent to the conducting parts 5 and connected to the cable shields 6 of the shielded cables 2 inside the cable 1. In all the figures the dimensions of the filter straps have been slightly exaggerated for purposes of illustration.

Figure 4:
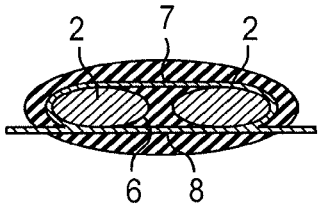
FIG. 4 is a practical realization of shield connecting elements.

The filter support portions 3 (conducting straps 8) are connected to the cable shields 6 as shown in FIG. 4. The conducting straps 8 are wrapped around the cable shields 6 and connect all of them. The number of turns of the conducting straps 8 is not relevant and can be increased in order to provide mechanical strength and improve the electrical contact with the cable shields 6. The material of the conducting straps 8 can be any conductive material, but a solderable conductive material is preferred, such as copper for instance. The conducting straps 8 can be soldered to the cable shields 6, but they do not need to be soldered. When they are not soldered, other methods of fastening the conducting straps 8 to the cable shields 6 can be provided, for example by pinning, or tying the ends of the conducting straps 8.

In one modified embodiment, the conducting straps 8 are covered by a removable insulator for example by an insulating tape. In another modified embodiment, the removable covering insulator also attaches the conducting straps 8 to the cable jacket 7.

Figure 5:
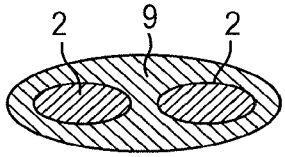
FIG. 5 is an optimal realization of shield connecting elements.

Different modifications of the first embodiments are also possible, as long as all the internal shields (cable shields 6) are accessible from outside. The connection between the internal shields (cable shields 6) can be realized also externally to the cables 1, although this is less effective for the reduction of the SDM current, since in some of the propagation modes the energy is concentrated between the cable shields 6. In other embodiments the conducting straps 8 can be rigid, such as the plates disclosed in the foreign patent document 10: U.S. Pat. No. 6,413,103, or can assume any shape. One example is shown in FIG. 5, where the conducting straps 8 in FIG. 4 are replaced by the full conducting surface 9 extending beyond the cable jacket 7. This configuration provides the best reduction of SDM current.

Even though some aspects of certain embodiments of foreign patent document 10 are very similar to some of the embodiments of the present patent, there are many important differences. The foreign patent document 10 aims at the reduction of the EMI by draining the current on the shields of coaxial cables on a ground surface. In the present invention the current on the cable shields 6 is reduced by means of other EMI filters 4, which generally do not need a ground connection. The shielded cables 2 under discussion here are any type of shielded cables, including coaxial cables, but not only. The conducting filter supports or conducting parts 5 are made in the eventuality of a filter connection, but they are supposed to remain on the cable 1 even if an EMI filter 4 is not used. For this reason in some of the embodiments they are covered by a cable insulator which is removable (it does not appear in the figures).

Figure 6:
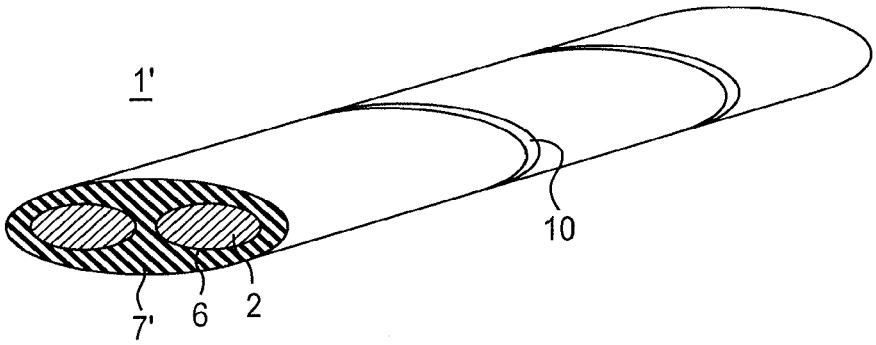
FIG. 6 is a multi-shielded cable with gaps.

A different modification of the embodiment is shown in FIG. 6. In this embodiment the conducting straps 8 described in FIG. 3 are not provided. In some positions along the cable 1', the cable jacket 7' has been removed forming some gaps 10, in such a way that at least one portion of the shield of each shielded cable 2 remains exposed, in order to connect an EMI filter 4 to the cable shields 6. The exposed parts of the shielded cables 2 can be covered by a removable insulator, for instance an insulating tape, but they do not necessarily need to be covered.

Figure 7A:
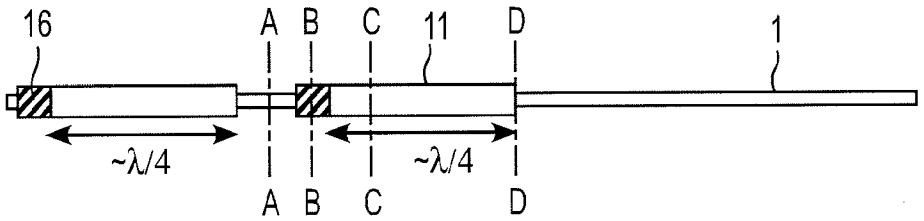
FIG. 7A is a side view of the wire of this invention which is provided with a plurality of sleeve chokes.

One of the embodiments relating to the EMI filter is explained by referring to FIGS. 7A~7E. In FIG. 7A, one or a plurality of sleeve chokes 11, which act as filters and includes sleeve choke insulators 16 and sleeve choke shields 17, are provided together with the cable 1. This can be convenient when the cable 1 is built for a particular function and strong EMI emission peaks are expected at one or few frequencies, for example as in the case of high frequency serial interface cables. In the figure four different cross sections are shown.

Figure 7B:
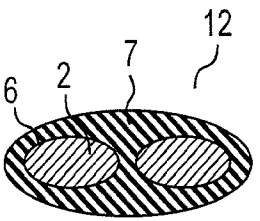
FIG. 7B is a cross section of A-A of the cable illustrated in FIG. 7A.

The cross-section 12 of FIG. 7B corresponds to the cross section of A-A of the cable 1 where the sleeve choke 11 is not present. This is only an example of a cable consisting of two shielded cables 2. The cross-section 14 of FIG. 7D corresponds to the cross section of C-C of the main part of the sleeve choke 11, which is approximately one quarter-wavelength long, at the frequency where the sleeve choke 11 is required to function. The exact optimal length of the sleeve choke 11 depends also on the cable and sleeve thicknesses, but at present it is not known. The wavelength must be calculated considering the dielectric constants of the cable insulator 7 and of the sleeve choke insulator 16. These sleeve choke and cable insulators 16 and 7 do not need to be homogeneous, and they can be composed of a plurality of different insulators, for example forming a plurality of layers with different dielectric and/or magnetic properties.

The sleeve choke insulator 16 has usually a larger dielectric constant than the cable insulator 7, in order to reduce the length of the sleeve choke 11, but it can have also the same dielectric constant or even a smaller one. The sleeve choke insulator 16 can be a lossy material, that is having considerable dielectric and/or magnetic losses, in order to further reduce the shield current also by dissipating energy, instead of only reflecting backwards the electromagnetic wave. Due to the complexity of typical configurations, usually a two-dimensional numerical simulation is necessary to calculate the wavelength. When the cable 1 is a coaxial cable, both insulators 7 and 16 have a cylindrical symmetry and closed form equations for the wavelength can be obtained.

Figure 7C:
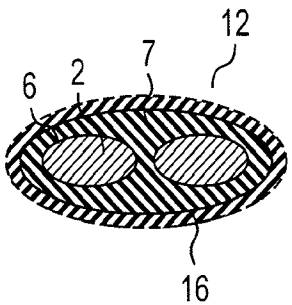
FIG. 7C is a cross section of B-B of the cable illustrated in FIG. 7A.
Figure 7D:
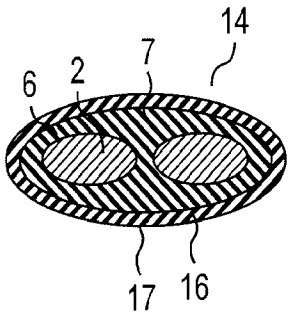
FIG. 7D is a cross section of C-C of the cable illustrated in FIG. 7A.
Figure 7E:
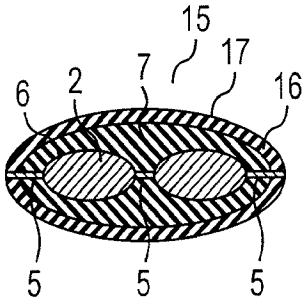
FIG. 7E is a cross section of D-D of the cable illustrated in FIG. 7A.

The cross-section 15 of FIG. 7E corresponds to the cross section of D-D which is at the end of the sleeve choke 11. In this region the conducting parts 5 of FIG. 2 are present and connected to the sleeve choke shield 17 of the sleeve choke 11. The connections between the cable shields 6 are responsible for a wide-bandwidth reflection of the SDM current, whereas the connection to the sleeve choke shield 17 and the cable shield 6 itself are responsible for the narrow-bandwidth reflection of the SCM.

The cross-section 13 of FIG. 7C corresponds to the cross section of B-B which is in the region which is near the other end of the sleeve choke 11 where the sleeve choke shield 17 does not exist. In this region, the choke insulator 16 can extend beyond the sleeve choke shield 17, in order to maintain the possibility of decreasing the resonance frequency of the sleeve chokes 11. This can be done by extending the length of the shield above a portion of the exposed choke insulator 16, for example by means of some copper tape. Another important advantage of this embodiment is that the electromagnetic energy in the space surrounding the cable is more concentrated in the proximity of the cable and a larger reduction of the SCM is expected. In other embodiments the choke insulator has the same length as the shield.

The sleeve chokes do not need to be identical, and they can be tuned at the same frequency or at different frequencies depending on the embodiment.

Any number and orientation of sleeve chokes 11 can be used, in the sense that the open part of the sleeve choke 11 can be directed towards any of the two cable ends. The sleeve chokes 11 can be used in combination with other types of EMI filters, for example broad-band ferrite beads or thin layers of lossy magnetic materials, inside or outside the sleeve choke.

In different embodiments different types of sleeve chokes can be used, not only of the quarter-wavelength sleeve type. These chokes can be obtained from already known baluns, for example in the non patent document 3, in a similar way as the sleeve choke was obtained from the sleeve balun.

In a different embodiment the sleeve chokes can be covered by an additional insulator, which in a different embodiment can cover the cable as well.

Some of the proposed embodiments are similar to some of those proposed in the foreign Patent Document 11: U.S. Pat. No. 6,284,971, however there are some important differences. The invention described in the foreign Patent Document 11 makes use of a plurality of quarter-wavelength sleeve chokes tuned at the same operating frequency, and it embraces cables having at most one shield and at least one internal conductors. The present invention, which includes also single-shielded cables, focuses on multi-shielded cables, which are cables comprising a plurality of shielded cables. This requires additional features, represented by the conducting filter supports, in order to reduce the SDM current by electrically connecting all the shields together. The present invention is not limited to one frequency and includes the possibility of combining the sleeve chokes with other EMI filter.

The invention described in the foreign Patent Document 11 does not distinguish between cable jacket and choke insulator, and it prescribes a single low-loss insulator extending from the shield of the sleeve choke to the cable shield. On the other hand, in the present invention, the number of insulators can be larger than one. This makes an important difference in the fabrication process, because in the present invention the sleeve chokes can be added at a different production stage than the cable jacket.

Figure 8:
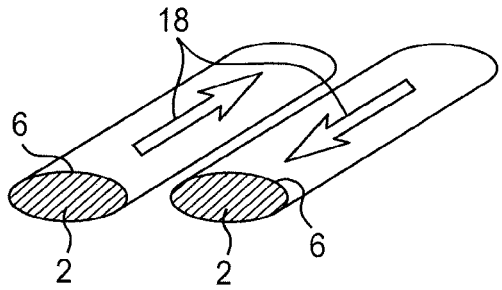
FIG. 8 PRIOR ART
FIG. 8 is a polarity of differential mode current on two cable shields.
Figure 9:
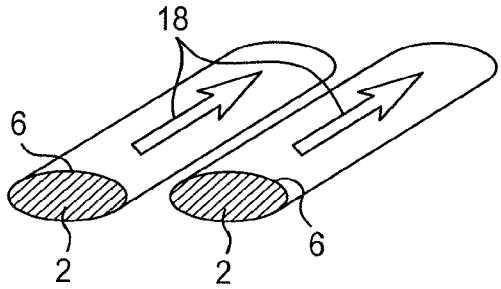
FIG. 9 PRIOR ART
FIG. 9 is a polarity of common mode current on two cable shields.

In FIGS. 8 and 9, the current polarities 18 of the SDM and SCM current in the case of two shields are shown.

FIGS. 10, 11, 12, 13 and 14 are examples of shielded cables to which the present invention can be applied. As already explained, other cables are also possible.

Figure 10:
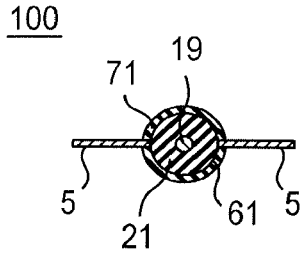
FIG. 10 is a diagrammatic representation of cross section of a coaxial cable.

FIG. 10 is a diagrammatic representation of the cross section of a coaxial cable 100. The coaxial cable 100 is the simplest shielded cable considered in this invention because it has only one internal conductor 19 covered by a cable insulator or jacket 21 wrapped with the cable shield 61. And outside the cable shield 6 is covered by the cable insulator 71. The conducting part 5 extending from the cable shield 61 to outside the cable insulator 71 is connected to the sleeve choke shield 17 of the sleeve choke 11 shown in FIG. 7A which covers outside the cable insulator 71.

Figure 11:
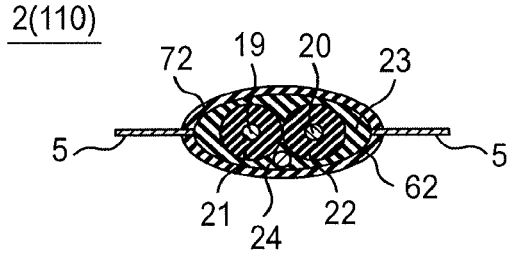
FIG. 11 is a diagrammatic representation of cross section of a twinax cable.

An example of shielded cable with the two internal conductors 19 and 20 is the twinax cable 110, which is diagrammatically represented in FIG. 11.

The insulator 21 covering the internal conductor 19, the insulator 22 covering the internal conductor 20 and the insulator 23 covering the insulators 21 and 22 are electrically isolating the internal conductors from the cable shield 62. The drain wire 24 has not been counted among the internal conductors because it is not isolated from the shield. In some twinax configurations there are two drain wires, and sometimes they are external to the cable 110. In such cases they can be considered as parts of the shield. The conducting part 5 extending from the cable shield 6 to outside the cable insulator 7 can be connected to the sleeve choke shield 17 of the sleeve choke 11 shown in FIG. 7 which covers outside the cable insulator 7.

Figure 12:
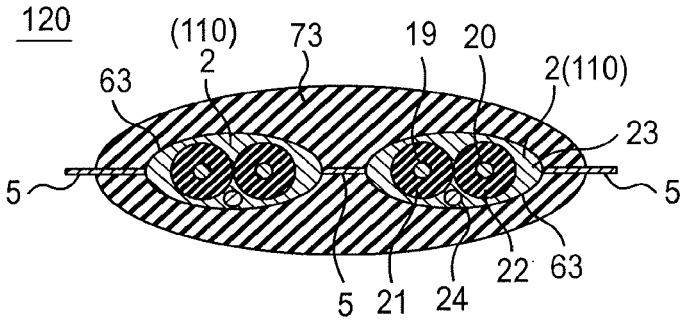
FIG. 12 is a diagrammatic representation of cross section of one lane of a SATA cable.

The SATA cable lane 120 diagrammatically represented in FIG. 12 can be considered as a combination of two twinax cables 110 sharing the same cable insulator (jacket) 73. And the structure of the SATA cable 120 is similar to that of the cable 1 as illustrated in FIG. 2 having the conducting part 5. The shielded cables 2 in FIG. 2 can correspond to the two twinax cables 110. In a high frequency serial interface cable (SATA or SAS for example), a combination of several lanes similar to the SATA cable lane 120 are used. Such lanes are usually connected with each other only at the connectors at the two ends of the cable.

Figure 13:
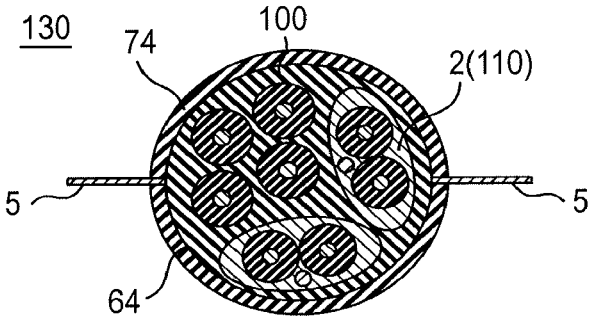
FIG. 13 is a diagrammatic representation of cross section of a USB 3.0 cable.
Figure 14:
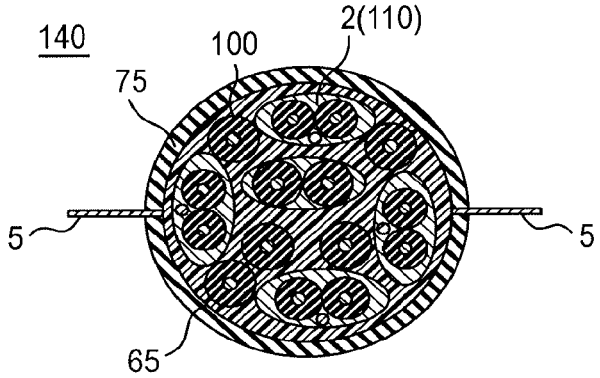
FIG. 14 is a diagrammatic representation of cross section of an HDMI cable.

In practice, cable having several shielding levels, similarly the USB 3.0 and HDMI configurations 130 and 140 in FIGS. 13 and 14, respectively, are expected to cause fewer problems related with EMI emissions, due to the additional external shield, but it depends also on the connector, which can be a source of SCM current. In these cases, the present invention can be applied to the most external cable shield 6 of a single or a combination of such cables 100 and 110, but also to the internal shields of the twinax cable 110. In particular, the embodiments that already include the sleeve chokes as explained by referring FIG. 7 or other types of filters can be applied also to internal shields, since no access to the shields is required after the fabrication.

In FIG. 10, the conducting part 5 is illustrated to extend from the cable shield 61 in both side, it is not necessarily extends in both side and only one side is usable. And same are in FIGS. 11 to 14.

Figure 15:
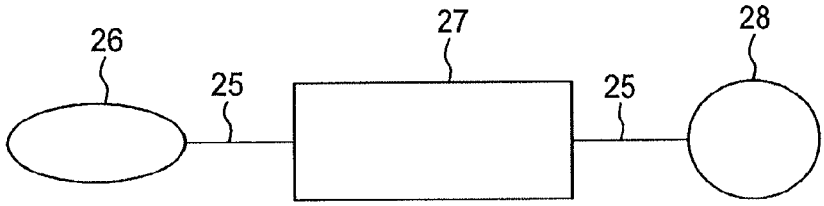
FIG. 15 is a simplified diagram of the combination of the shield cables.

In FIG. 15, a plural cables 1 corresponding to FIG. 2 are connected by the conducting parts 5 as illustrated in FIG. 2. By connecting plural cables 1 with the conducting parts 5, and connecting the outer conducting part 5 to an optimal filter (not illustrated in FIG. 15), electromagnetic interference can be easily eliminated.

Figure 16:
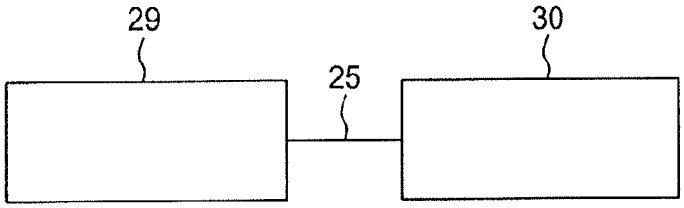
FIG. 16 is an example of electronic equipment with cable.
Figure 17:
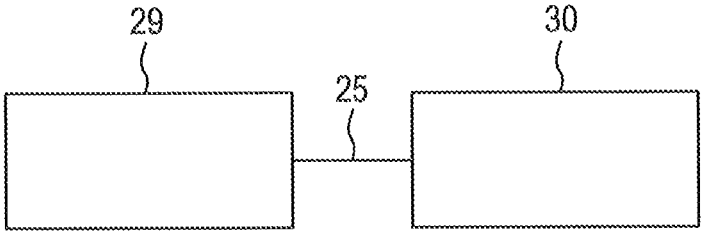
FIG. 17 is an example of combination of electronic equipments with cable.
Figure 18:
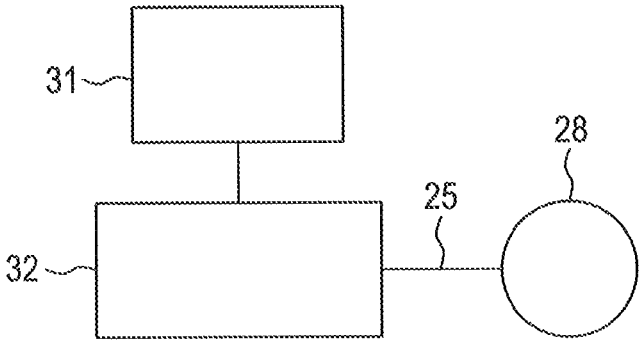
FIG. 18 is an example of electronic equipment with cable.
Figure 19:
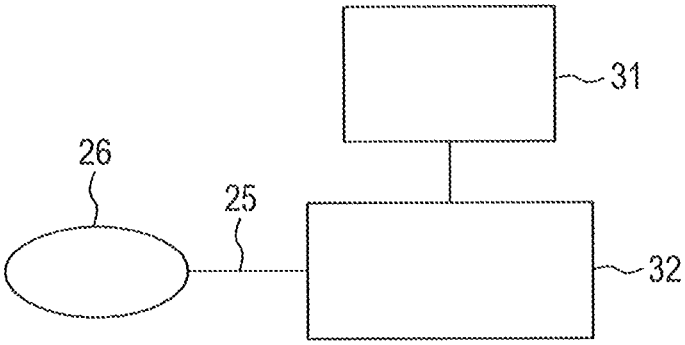
FIG. 19 is an example of electronic equipment with cable.

The invention is extended to electrical equipments including the cable as explained above. One example is shown in FIG. 16, where cables with EMI filter 25 are used in the interface between a controlling and/or processing unit 27 and a storage memory 28, and/or between the unit 27 and the input/output (I/O) interfaces 26. The invention is extended also to external interfaces connecting two or more electronic equipments, schematically represented with 29 and 30 in FIG. 17. The invention is extended also to a subsystem of an electronic equipment, for example an internal interface to a storage medium comprising the interface controller 32, a central processing unit 31 and the storage memory 28, as shown in FIG. 18, or an interface to an input/output interface 26, as shown in FIG. 19. More in general the invention is extended to any electronic equipment using the invented cable with the purpose of reducing EMI.

According to the invention, since the conducting filter support (5, 8) extends outside the cable or a cable insulator having gaps (10) which enables contact conductive cable shield from outside, any type of filter having different feature can be easily connected. And easily change the filter which suite the cable in using particular electric power. This means that the electrical frequency range applying to the cable is not limited because the filter can be changed by the frequency.

The invention claimed is:

1. A low-noise cable comprising:

a shielded cable having an internal conductor covered by an insulator which is wrapped by a conductive cable shield and outside the cable shield is covered by a cable insulator; and a conducting support without a filter, wherein the conducting support is connected to the cable shield and extends outside the cable insulator.

2. An electrical equipment comprising:

a first electrical equipment; and a second electrical equipment, wherein said first electrical equipment and said second electrical equipment are connected by the low-noise cable as defined by claim 1.

3. An electrical equipment according to claim 2, wherein said first electrical equipment is a controlling and/or processing, unit and said second electrical equipment is an input/output interface controller.

4. An electrical equipment according to claim 2, wherein said first electrical equipment is a storage memory and said second electrical equipment is an input/output interface and/or interface controller.

5. A low-noise cable comprising:

a shielded cable having plural internal conductors which are covered by insulators and said insulators are wrapped with conductive cable shields and outside the conductive cable shields are covered by a cable insulator; and a conducting support without a filter, wherein the conducting support is connected to at least one of the cable shields and extends outside the cable insulator.

6. A low-noise cable according to claim 5, further comprising a filter which reduces electromagnetic interference, wherein said filter is a quarter-wavelength sleeve choke which covers said shielded cable, said quarter-wavelength sleeve choke including:

a sleeve choke insulator which wraps the cable insulator; and a conductive sleeve choke shield which covers the sleeve choke insulator.

7. A low-noise cable according to claim 6, wherein said conductive sleeve choke having a length about a quarter-wavelength of a wavelength applied to the internal conductors.

8. A low-noise cable according to claim 6, wherein said sleeve choke insulator has a larger dielectric constant than the cable insulator.

9. A low-noise cable according to claim 6, wherein said sleeve choke insulator is longer than said conductive sleeve choke shield.

10. An electrical equipment comprising:

a first electrical equipment; and a second electrical equipment, wherein said first electrical equipment and said second electrical equipment are connected by the low-noise cable as defined by claim 5.

11. An electrical equipment according to claim 10, wherein said first electrical equipment is a controlling and/or processing unit and said second electrical equipment is an input/output interface controller.

12. An electrical equipment according to claim 10, wherein said first electrical equipment is a storage memory and said second electrical equipment is an input/output interface and/or interface controller.

13. A low-noise cable comprising:

a shielded cable having plural internal conductors each covered by a insulator; and a conducting support without a filter, wherein said insulators covering said plural internal conductors are wrapped with conductive cable shield and said conductive cable shield is covered by a cable insulator: and wherein the conducting support is connected to said conductive cable shield and extends outside the cable insulator.

14. A low-noise cable according to claim 13, wherein some of said plural internal conductors each covered by said insulator are wrapped with an internal conductive shield.

15. A low-noise cable according to claim 13, further comprising a filter which reduces electromagnetic interference, wherein said filter is a quarter-wavelength sleeve choke which covers said shielded cable, said quarter-wavelength sleeve choke including:

a sleeve choke insulator which wraps the cable insulator; and a conductive sleeve choke shield which covers the sleeve choke insulator.

16. A low-noise cable according to claim 15, wherein said conductive sleeve choke having a length about a quarter-wavelength of a wavelength applied to the internal conductors.

17. A low-noise cable according to claim 15, wherein said sleeve choke insulator has a larger dielectric constant than the cable insulator.

18. A low-noise cable according to claim 15, wherein said sleeve choke insulator is longer than said conductive sleeve choke shield.

19. An electrical equipment comprising:

a first electrical equipment; and a second electrical equipment, wherein said first electrical equipment and said second electrical equipment are connected by the low-noise cable as defined by claim 13.

20. An electrical equipment according to claim 19, wherein said first electrical equipment is a controlling and/or processing unit and said second electrical equipment is an input/output interface controller.

21. An electrical equipment according to claim 19, wherein said first electrical equipment is a storage memory and said second electrical equipment is an input/output interface and/or interface controller.

* * * * *